US012571273B2

(12) United States Patent
Sommer et al.

(10) Patent No.: US 12,571,273 B2
(45) Date of Patent: Mar. 10, 2026

(54) DOWNHOLE RADIAL FORCE TOOL ASSEMBLY

(71) Applicant: WELLTEC A/S, Allerød (DK)

(72) Inventors: Rasmus Sommer, Allerød (DK); Tomas Sune Andersen, Allerød (DK)

(73) Assignee: WELLTEC A/S, Allerød (DK)

( * ) Notice: Subject to any disclaimer, the term of this patent is extended or adjusted under 35 U.S.C. 154(b) by 0 days.

(21) Appl. No.: 18/671,673

(22) Filed: May 22, 2024

(65) Prior Publication Data

US 2024/0392640 A1 Nov. 28, 2024

(30) Foreign Application Priority Data

May 23, 2023 (EP) ..... 23174932
Jun. 23, 2023 (EP) ..... 23181203

(51) Int. Cl.
*E21B 23/04* (2006.01)
*E21B 17/10* (2006.01)

(52) U.S. Cl.
CPC ..... *E21B 23/0411* (2020.05); *E21B 17/1021* (2013.01); *E21B 23/0419* (2020.05)

(58) Field of Classification Search
CPC ..... E21B 23/0411; E21B 17/1021; E21B 23/0419; E21B 17/1057; E21B 23/01
See application file for complete search history.

(56) References Cited

U.S. PATENT DOCUMENTS 4,941,532 A 7/1990 Hurt et al.
4,971,146 A 11/1990 Terrell
6,464,003 B2 10/2002 Bloom et al.
6,640,894 B2 11/2003 Bloom et al.
6,715,559 B2 4/2004 Bloom et al.
6,796,380 B2 9/2004 Xu
6,892,811 B2 5/2005 LaClare et al.
6,920,936 B2 7/2005 Sheiretov et al.
7,048,047 B2 5/2006 Bloom et al.
(Continued)

FOREIGN PATENT DOCUMENTS

EP 0370591 A2 5/1990
WO 9601408 A1 1/1996

OTHER PUBLICATIONS

Extended European Search Report for EP23174932.6 dated Oct. 19, 2023, 10 pages.

*Primary Examiner* — Tara Schimpf
*Assistant Examiner* — Daniel T Craig
(74) *Attorney, Agent, or Firm* — Nixon & Vanderhye P.C.

(57) ABSTRACT

A radial force tool assembly has a first force-transmitting member with a first end with a first face and a second face, a first rear arm member having a first end face abutting the first face and a second end face, and a second rear arm member having a first end face abutting the second face and a second end face. The first end faces are curved so that when the first force-transmitting member moves towards the front, the first end face of the first rear arm member rolls on the first face, projecting the first rear arm member radially outwards in a first radial direction, and the first end face of the second rear arm member rolls on the second face, projecting the second rear arm member radially outwards in a second radial direction opposite the first direction while projecting the first and second rear arm members.

17 Claims, 6 Drawing Sheets

(56) References Cited

U.S. PATENT DOCUMENTS

Figure 1:
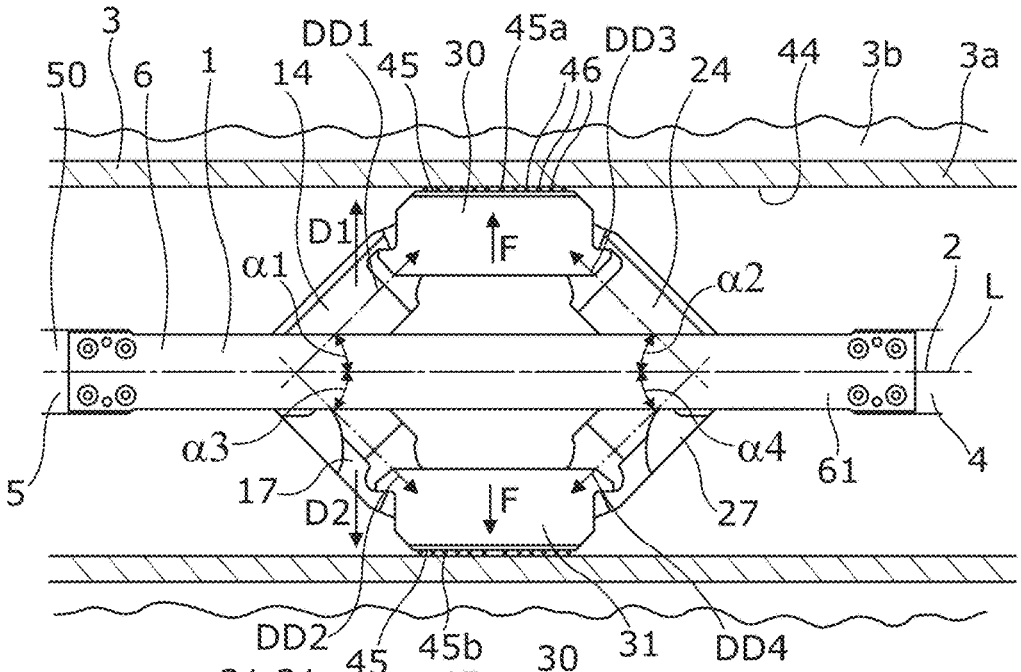

| | | | | |
|---|---|---|---|---|
| 7,278,482 | B2 | 10/2007 | Azar | |
| 7,334,642 | B2 | 2/2008 | Doering et al. | |
| 7,886,834 | B2 | 2/2011 | Spencer et al. | |
| 9,447,648 | B2 * | 9/2016 | Mitchell | E21B 4/18 |
| 2003/0173076 | A1 | 9/2003 | Sheiretov et al. | |
| 2006/0180318 | A1 | 8/2006 | Doering et al. | |
| 2009/0071659 | A1 | 3/2009 | Spencer et al. | |
| 2009/0223659 | A1 | 9/2009 | Hill et al. | |
| 2020/0040679 | A1 * | 2/2020 | Mauchien | E21B 17/1021 |

* cited by examiner

DOWNHOLE RADIAL FORCE TOOL ASSEMBLY

This application claims priority to EP 23181203.3 filed Jun. 23, 2023, and EP 23174932.6 filed May 23, 2023, the entire contents of which are hereby incorporated by reference.

The present invention relates to a radial force tool assembly for providing a radial force perpendicularly to an axial extension of the radial force tool assembly in a well for anchoring, centralising or rolling a downhole intervention tool in a well having a borehole, the radial force tool assembly having a centre axis, a front end and a rear end. The invention also relates to a downhole intervention tool comprising the radial force tool assembly.

Radial force generators are known in the hydrocarbon industry for anchoring a downhole tool in a well, e.g. for pulling or setting a plug, in order to transfer the axial force into a pulling or pushing force along the axial extension of the well tubular metal structure. Radial force generators may also be used for centralising a tool in the well for performing a certain operation needing centralising, such as logging or imaging.

Some wells have a narrow restriction, and the anchoring tool then needs to be set further downhole of the restriction so that the radial force generator has to have a sufficient radial extension, while still delivering sufficient force. The known radial force generators are not able to provide an extension of more than twice the outer diameter of the tool, which is not always enough. Therefore, attempts have been made to enhance the design to provide a longer radial extension, but when the generators are only projected in a small angle in relation to the axial extension of the tool, the radial force generator provides a very limited amount of force. A radial force generator is known from U.S. Pat. No. 6,920,936, which has a very complex design where rollers on arms are arranged to support the projected arms when the arms are only slightly projected to overcome the problem of very limited force at small angles. However, such complicated design has many parts which may get stuck or worn out, and the known radial force generators still have a very limited radial extension.

It is an object of the present invention to wholly or partly overcome the above disadvantages and drawbacks of the prior art. More specifically, it is an object to provide an improved radial force tool assembly which can be used in a variety of well sizes and preferably have a longer radial extension than known tools.

Furthermore, it is an object to provide an improved radial force tool assembly which can enter a narrow restriction in the well and expand below the restriction in a section of the well which has an inner diameter of at least 3 times the inner diameter of the restriction, while still providing sufficient force to anchor an intervention tool.

The above objects, together with numerous other objects, advantages and features, which will become evident from the below description, are accomplished by a solution in accordance with the present invention by a radial force tool assembly for providing a radial force perpendicularly to an axial extension of the radial force tool assembly in a well for anchoring, centralising or rolling a downhole intervention tool in a well having a borehole, the radial force tool assembly having a centre axis, a front end and a rear end, and comprising:

- a tool body comprising a cavity extending across the tool body, the cavity comprising a first cavity face facing opposite a second cavity face,

- a first actuator moving a first force-transmitting member in relation to the tool body along the axial extension, wherein the first force-transmitting member has a first end with a first face and a second face, and
- a first rear arm member having a first end face abutting the first face and a second end face, and a second rear arm member having a first end face abutting the second face and a second end face, and wherein each of the first end faces has a curvature so that when the first force-transmitting member moves towards the front, the first end face of the first rear arm member rolls on the first face, projecting the first rear arm member radially outwards in a first radial direction, and the first end face of the second rear arm member rolls on the second face, projecting the second rear arm member radially outwards in a second radial direction opposite the first direction while projecting the first and second rear arm members.

Furthermore, the first face and the second face of the first end of the force-transmitting member may be one face.

Moreover, the first face may be a first inclined face, and/or the second face may be a second inclined face.

Additionally, the first rear arm member may be projectable radially outwards in a first direction, the second rear arm member being projectable radially outwards in a second radial direction opposite the first direction.

Also, each of the second end faces of the first and second rear arm members may have a curvature.

Further, the curvature may be shaped like the profile of half of a tooth of an involute gear, a trochoid gear or a cycloidal gear.

In addition, the curvature may follow an involute of a circle.

Furthermore, as the curvature may follow an involute of a circle or the like, the first end face of the first rear arm member is enabled to roll and not slide on the first face since the first rear arm member is projecting radially outwards in a first radial direction.

In prior art tools, the members are hingedly or "linkagely" connected, and this creates high friction causing wear in the connection. Furthermore, the force is translated and transmitted almost entirely from the first force-transmitting member to the first and second rear members in an optimal manner.

Also, each of the first end faces may have a curvature following an involute of a circle so that each first end face is shaped as the profile of half of a tooth of an involute gear.

Furthermore, each of the first end faces may have a curvature formed by a circle rolling along a line so that each first end face is shaped like the profile of half of a tooth of a trochoid gear.

In addition, each of the first end faces may have the curvature so that each first end face is shaped like the profile of half of a tooth of an involute gear, a trochoid gear or a cycloidal gear.

The invention also relates to a radial force tool assembly for providing a radial force perpendicularly to an axial extension of the radial force tool assembly in a well for anchoring, centralising or rolling a downhole intervention tool in a well having a borehole, the radial force tool assembly having a centre axis, a front end and a rear end, and comprising:

- a tool body comprising a cavity extending across the tool body, the cavity comprising a first cavity face facing opposite a second cavity face,
- a first actuator moving a first force-transmitting member in relation to the tool body along the axial extension, wherein the first force-transmitting member has a first end with a first face and a second face, the first and second faces inclining in opposite directions, and a first rear arm member having a first end face abutting the first face and a second end face, and a second rear arm member having a first end face abutting the second face and a second end face, and wherein each of the first end faces has a curvature so that when the first force-transmitting member moves towards the front, the first end face of the first rear arm member rolls on the first face, projecting the first rear arm member radially outwards in a first radial direction, and the first end face of the second rear arm member rolls on the second face, projecting the second rear arm member radially outwards in a second radial direction opposite the first direction while projecting the first and second rear arm members, where each of the first end faces having the curvature is shaped like the profile of half of a tooth of an involute gear, a trochoid gear or a cycloidal gear.

Moreover, the first rear arm member or the first cavity face may comprise a projection engaging a guide in the other of the first rear arm member and the first cavity face, and the second rear arm member or the second cavity face may comprise a projection engaging a guide in the other of the second rear arm member and the second cavity face, wherein the projection of the first rear arm member going radially outwards in a first direction and the projection of the second rear arm member going radially outwards in a second direction opposite the first direction may be performed while the projections slide in the guides.

In addition, the radial force tool assembly may further comprise a first front arm member having a first end face and a second end face, and a second front arm member having a first end face and a second end face, the first end faces abutting a first face in the tool body, e.g. of the force-transmitting member.

Furthermore, the force-transmitting member may have a projection or a circular slot, or similar slot shape, engaging the other of the projection and the circular slot of the first rear arm member and the second rear arm member.

Additionally, the first front arm member or the first cavity face may comprise a projection engaging a guide in the other of the first front arm member and the first cavity face, the second front arm member or the second cavity face comprising a projection engaging a guide in the other of the second front arm member and the second cavity face.

Moreover, the first and second end faces of the first front arm member and the first second arm member may have a curvature.

In addition, the curvature may be shaped like the profile of half of a tooth of an involute gear, a trochoid gear or a cycloidal gear.

Also, the curvature may follow an involute of a circle.

Thus, the connection of the arm members to the tool body is different from the main force translation area as this occurs at the curvature of the arm members.

In addition, by having the curvature on all second end faces of the arm members following an involute of a circle, the translation of force may be like in a gear where the same amount of force is translated in every position, so in other words, the radial force tool assembly may translate an equal amount of force in every position i.e. the same translation of force in both fully extended and almost retracted positions.

Additionally, the first front arm member may be projectable radially outwards in the first direction, the second front arm member being projectable radially outwards in the second radial direction opposite the first direction.

Further, when projecting, the first rear arm member may extend in a first diagonal direction between the first radial direction and the axial extension, and at a first angle to the axial extension.

Also, when projecting, the second rear arm member may extend in a second diagonal direction between the second radial direction and the axial extension, and at a second angle to the axial extension.

Moreover, when projecting, the first front member may extend in a third diagonal direction between the first radial direction and the axial extension, and at a third angle to the axial extension.

Furthermore, when projecting, the second front member may extend in a fourth diagonal direction between the second radial direction and the axial extension, and at a fourth angle to the axial extension.

In addition, the first diagonal direction and the third diagonal direction may be parallel.

Further, the second diagonal direction and the fourth diagonal direction may be parallel.

Moreover, the first angle, the second angle, the third angle and the fourth angle may be of equal size.

In addition, the first angle, the second angle, the third angle and/or the fourth angle may be in the range of 0-60°, preferably in the range of 0-45°.

Also, the cavity may extend along the axial extension.

Furthermore, the first rear arm member may be slidably arranged in the cavity and may have a first arm centre axis extending along the axial extension at a first distance to the centre axis of the radial force tool assembly.

Moreover, the second rear arm member may be slidably arranged in the cavity and may have a second arm centre axis extending along the axial extension at a second distance to the centre axis of the radial force tool assembly, and the first distance may be equal to the second distance.

In addition, the first front arm member may be slidably arranged in the cavity and may have the first arm centre axis.

Further, the second front arm member may be slidably arranged in the cavity and may have the second arm centre axis.

Also, the radial force tool assembly may further comprise a first contact element and a second contact element, the first contact element being connected with the second end faces of the first rear arm member and the first front arm member, and the second contact element being connected with the second end faces of the second rear arm member and the second front arm member.

Thus, the arm members do not contact the surrounding wall of the borehole or the well tubular metal structure. The contact elements contact the surrounding wall of the borehole or the well tubular metal structure.

In addition, the first contact element may connect the first rear arm member and the first front arm member, and the second contact element may connect the second rear arm member and the second front arm member. Thus, the first rear arm member and the first front arm member are not directly connected, and the second rear arm member and the second front arm member are not directly connected.

The first and second rear arm members and the first and second front arm members may have equal length.

Moreover, by having four arm members connected with two contact elements where the force is translated between a face and a curvature following an involute of a circle, the translation and transmission of force may occur in a rolling motion like that of an involute gear.

Thus, by having four arm members connected with two contact elements where the force is translated and transmitted between a face and the curvature, the translation of force may occur in a rolling motion like that of an involute gear, a trochoid gear or a cycloidal gear.

In addition, the first contact element may be connected with the second end faces of the first rear arm member and the first front arm member by means of another projection engaging a guide, and the second contact element may be connected with the second end faces of the second rear arm member and the second front arm member by means of another projection engaging a guide.

Further, each of the first contact element and the second contact element may comprise a first face and a second face, the first face of the first contact element abutting the second end face of the first rear arm member, the second face of the first contact element abutting the second end face of the first front arm member, the first face of the second contact element abutting the second end face of the second rear arm member, and the second face of the second contact element abutting the second end face of the second front arm member.

Additionally, by having four arm members connected with two contact elements where the force is translated between a face, e.g. being inclined or curved, and a curvature following an involute of a circle, the translation and transmission of force may occur in a rolling motion like that of an involute gear. The first half of the involute tooth may be arranged as the first end face of the first rear arm member, the second half of the involute tooth being arranged as the second end face of the first rear arm member, and the first face of the first force-transmitting member and the first face of the first contact element functioning as the engaging tooth so that the first rear arm member is pressed in between the first face and the first face. The other arm members may be arranged in a similar manner, and in this way the radial force at which the contact elements press towards the wall of the tubing or borehole is the same independently of the angle of the arm members. This is very different from the known solutions which have a varying ability of force transfer for varying angles, and therefore the known solutions are designed for transferring force in a very limited range so either close to the tool body or a fully extended.

Also, the first faces and the second faces may be inclined in relation to the axial extension.

Moreover, the first faces and the second faces may be curved.

In addition, each of the second end faces of the first and second rear arm members and the first and second front arm members may have a curvature following an involute of a circle so that the second end face rolls on the first and second faces, and the first end faces of the first and second rear arm members roll on the first and second faces of the first force-transmitting member, projecting the arm members radially outwards while the projections slide in the guides.

By having four arm members connected with two contact elements where the force is translated between a face and a curvature following an involute of a circle, the translation and transmission of force may occur in a rolling motion like that of an involute gear. The first half of the involute tooth may be arranged as the first end face of the first rear arm member, the second half of the involute tooth may be arranged as the second end face of the first rear arm member, and the first face of the first force-transmitting member and the first face of the first contact element may function as the engaging tooth so that the first rear arm member is pressed in between the first face and the first face. The other arm members may be arranged in a similar manner, and in this way the radial force at which the contact element presses towards the wall of the tubing or borehole is the same independently of the angle of the first rear arm member. This is very different from the known solutions using hinged connections, and where some also have a supporting roller structure.

Further, the radial force tool assembly may also comprise a second actuator moving a second force-transmitting member in relation to the tool body along the axial extension, the second force-transmitting member having a first end with a first face and a second face, the first and second faces may be inclining in opposite directions, wherein the first end face of the first front arm member abuts the first face, and the first end face of the second front arm member abuts the second face of the second force-transmitting member.

In that way, the arm members may be forced to move from both sides.

Also, the first contact element may have a first contact face facing radially outwards towards a wall of a tubing or the borehole, and the second contact element may have a first contact face facing radially outwards towards a wall of the borehole.

Moreover, the first contact faces of the first contact element and the second contact element may be equipped with projections such as spikes or similar projections for increasing the friction between the first contact faces and the wall.

In addition, the radial force tool assembly may be an anchoring tool assembly where the first contact element and the second contact element are equipped with projections such as spikes or similar projections for increasing the friction between the first faces and the wall.

Furthermore, the first contact faces of the first contact element and the second contact element may be equipped with rollers.

Moreover, each of the first end faces may have the curvature so that each first end face is shaped like the profile of half of a tooth of an involute gear, a trochoid gear or a cycloidal gear.

Further, each of the second end faces of the first and second rear arm members and the first and second front arm members may have the curvature so that each second end face is shaped like the profile of half of a tooth of an involute gear, a trochoid gear or a cycloidal gear.

Also, the first face and the second face of the first end of the force-transmitting member(s) may be one face.

Also, the first contact element may be equipped with first engagement elements, each engaging a second engagement element of the first rear arm member and the first front arm member, respectively, and the second contact element may be equipped with first engagement elements, each engaging a second engagement element of the second rear arm member and the second front arm member, respectively.

Further, the cavity may be formed by a cut-out in the tool body and a lid plate.

In addition, the first rear arm member may comprise a first wing profile having a wing curvature, the second rear arm member may comprise a first wing profile having a wing curvature, and the wing curvature of the first rear arm member may roll on the wing curvature of the second rear arm member when the arm members project from the tool body.

Also, each of the first wing profiles of the first rear arm member may have the wing curvature, and the first wing profile of the second rear arm member may have the wing curvature so that each wing profile is shaped like the profile of half of a tooth of an involute gear, a trochoid gear or a cycloidal gear.

Moreover, the wing curvature may have a centre point positioned outside the radial force tool assembly.

In addition, the first rear arm member and the second rear arm member may slide in the cavity in a side-by-side manner so that the first wing profile and the second wing profile slide in relation to each other.

Further, the first front arm member may comprise a first wing profile having a wing curvature, the second front arm member may comprise a first wing profile having a wing curvature, and the wing curvature of the first front arm member may roll on the wing curvature of the second front arm member when the arm members project from the tool body.

Also, the actuator may be an electric actuator having an electric motor providing a linear movement of a shaft along the axial extension via a gear unit, or the actuator may be a hydraulic actuator that may comprise a piston moving in a chamber in the tool body along the axial extension.

Furthermore, a spring element in the chamber may be compressed as the piston moves to project the arm members.

Moreover, the arm members may have a retracted position in which the arm members are arranged in the cavity, and the arm members may have a projected position in which the arm members project from the tool body.

In addition, the force-transmitting member may have a projection sliding in a slot extending along the axial extension of the tool body.

Further, the tool body may have an outer diameter, and in the projected position of the arm members, the first face of the first contact element may have a distance to the first face of the second contact element, which distance may be at least 4 times the outer diameter.

Finally, the invention also relates to a downhole intervention tool comprising the radial force tool assembly and a stroking tool, and the downhole intervention tool may further comprise an electric motor powered by a wireline and driving a pump supplying hydraulic fluid to the stroking tool for providing an axial force on an element by means of a hydraulic cylinder.

Figure 2:
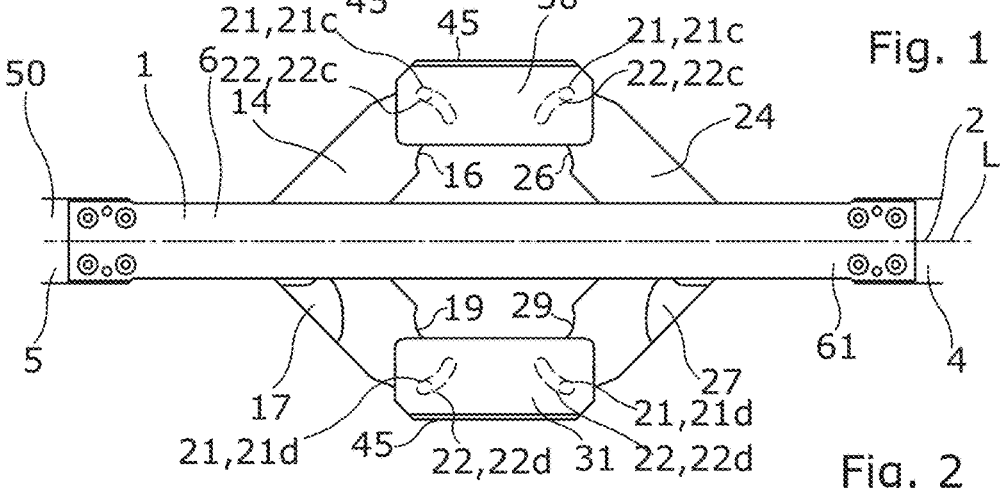
Figure 3:
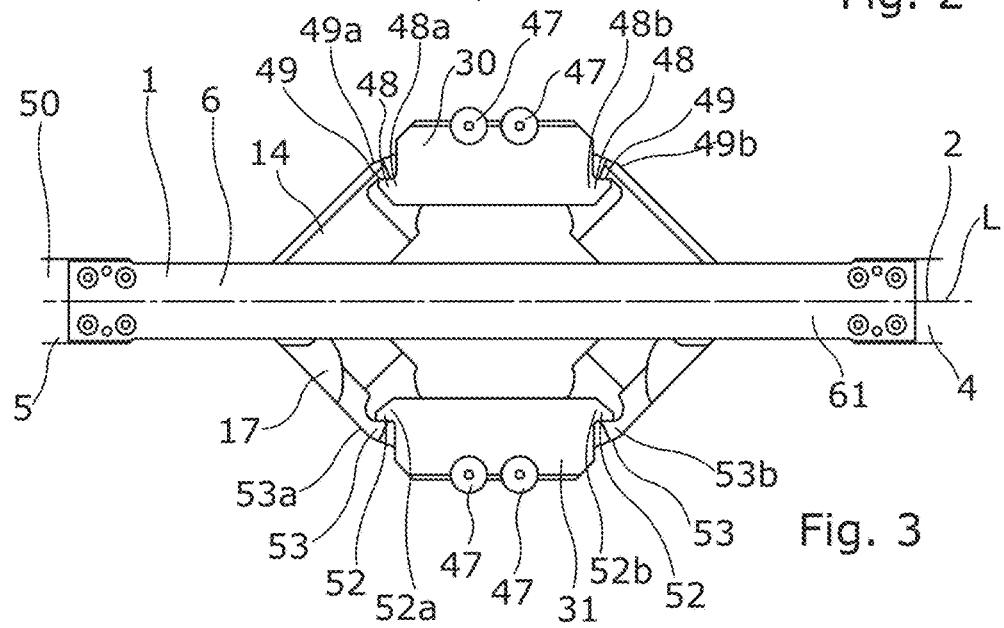
Figure 4:
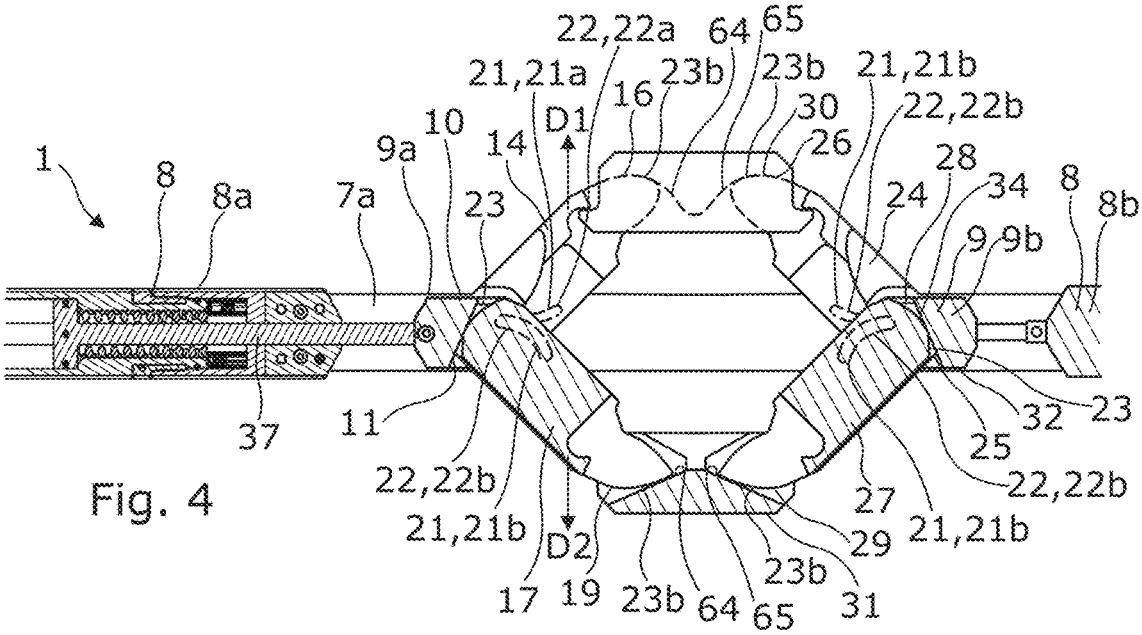
Figure 5:
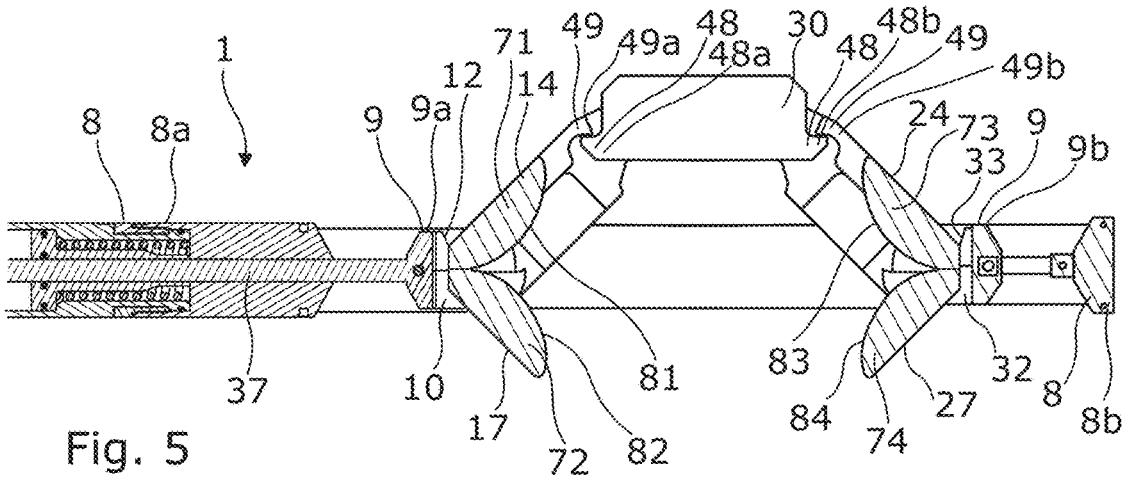
Figure 6:
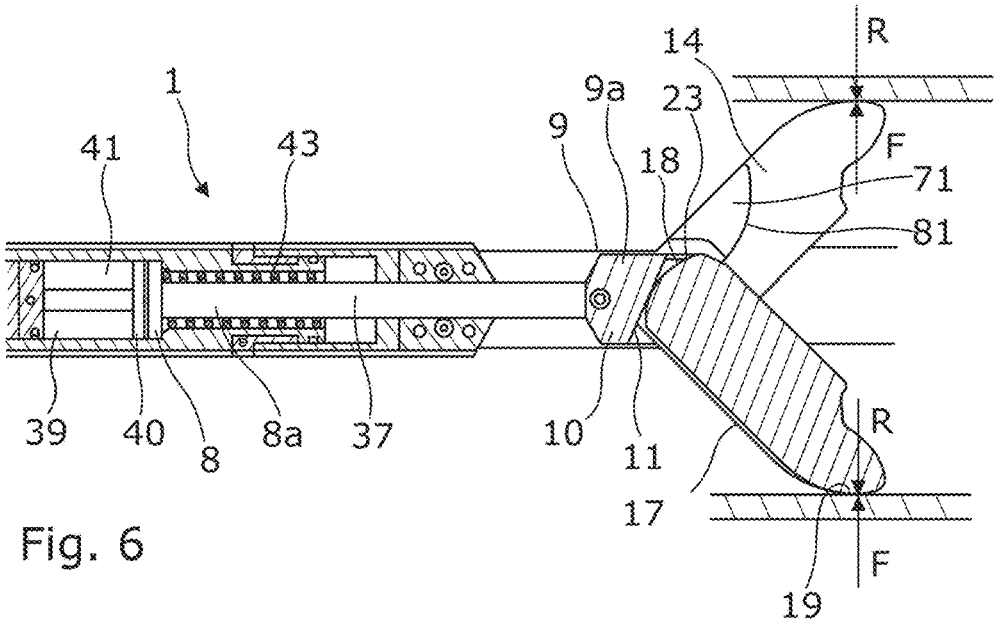
Figure 7:
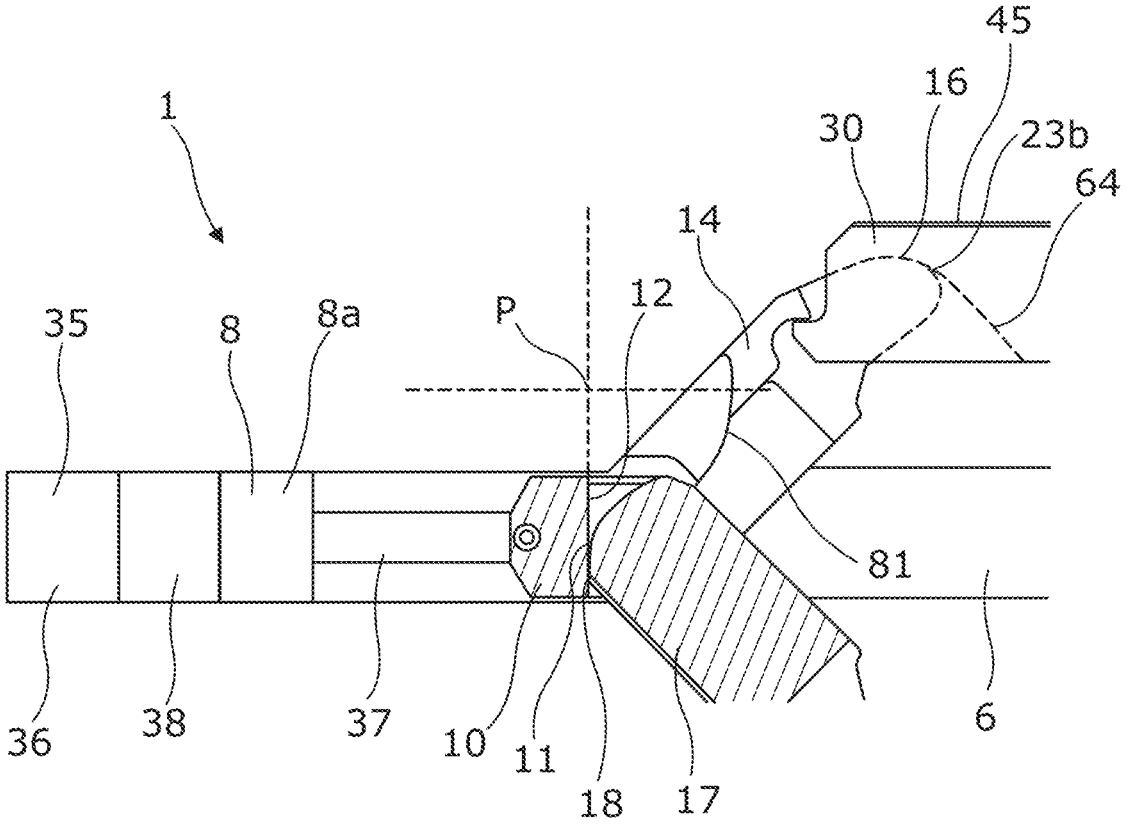
Figure 8:
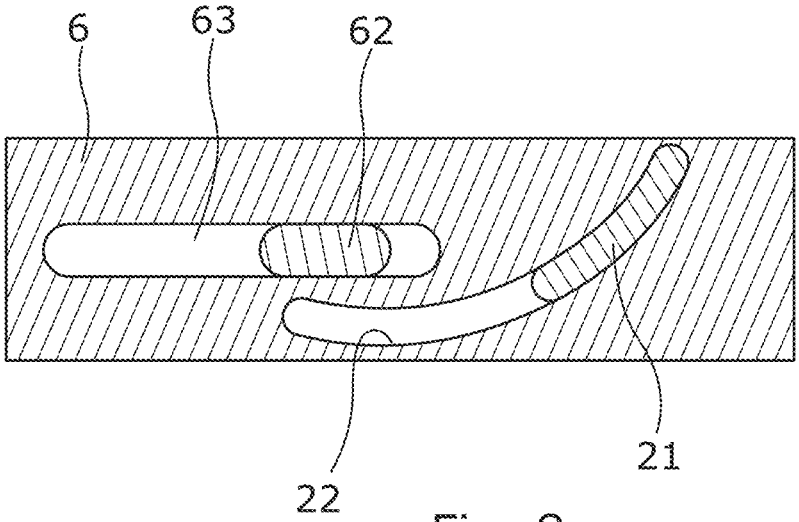
Figure 9:
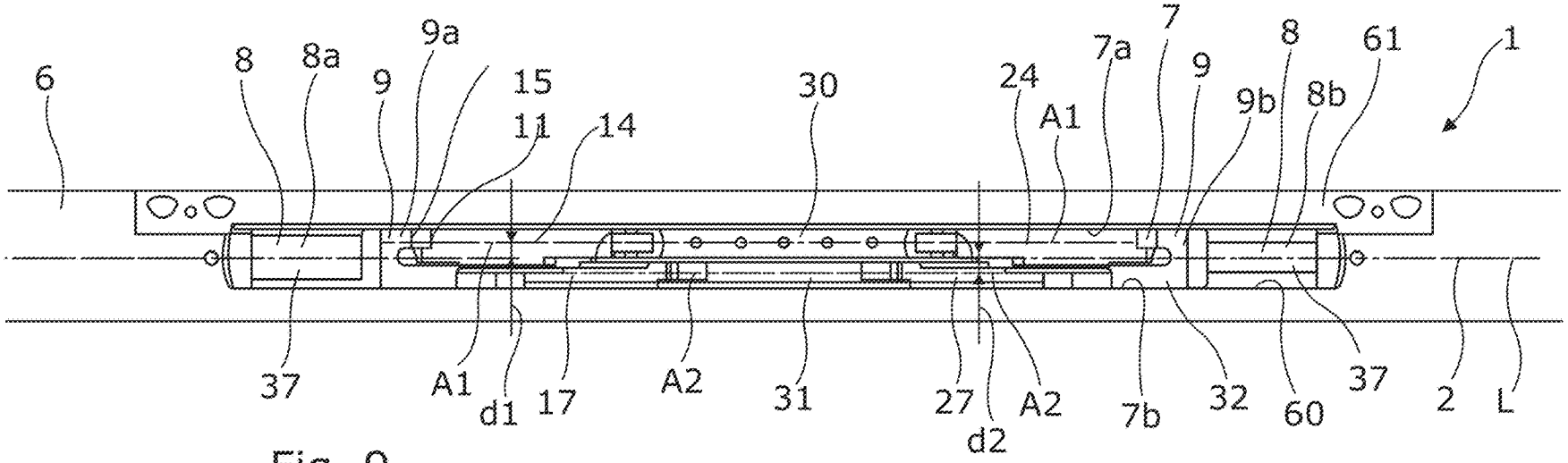
Figure 10:
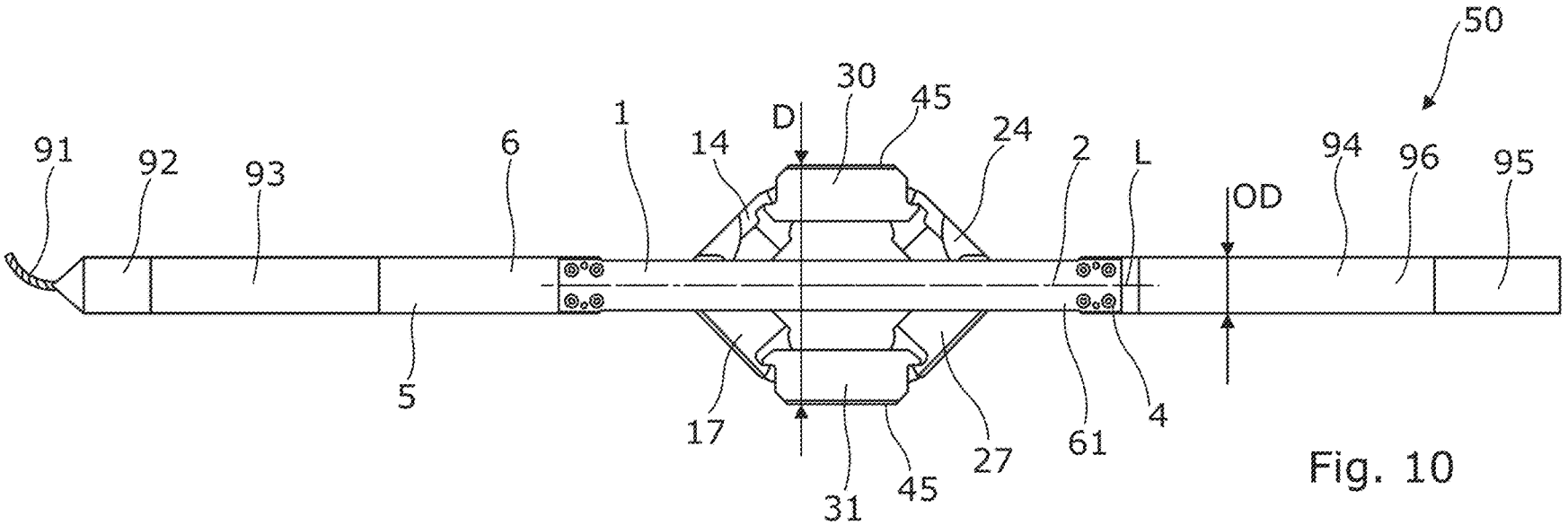
Figure 11:
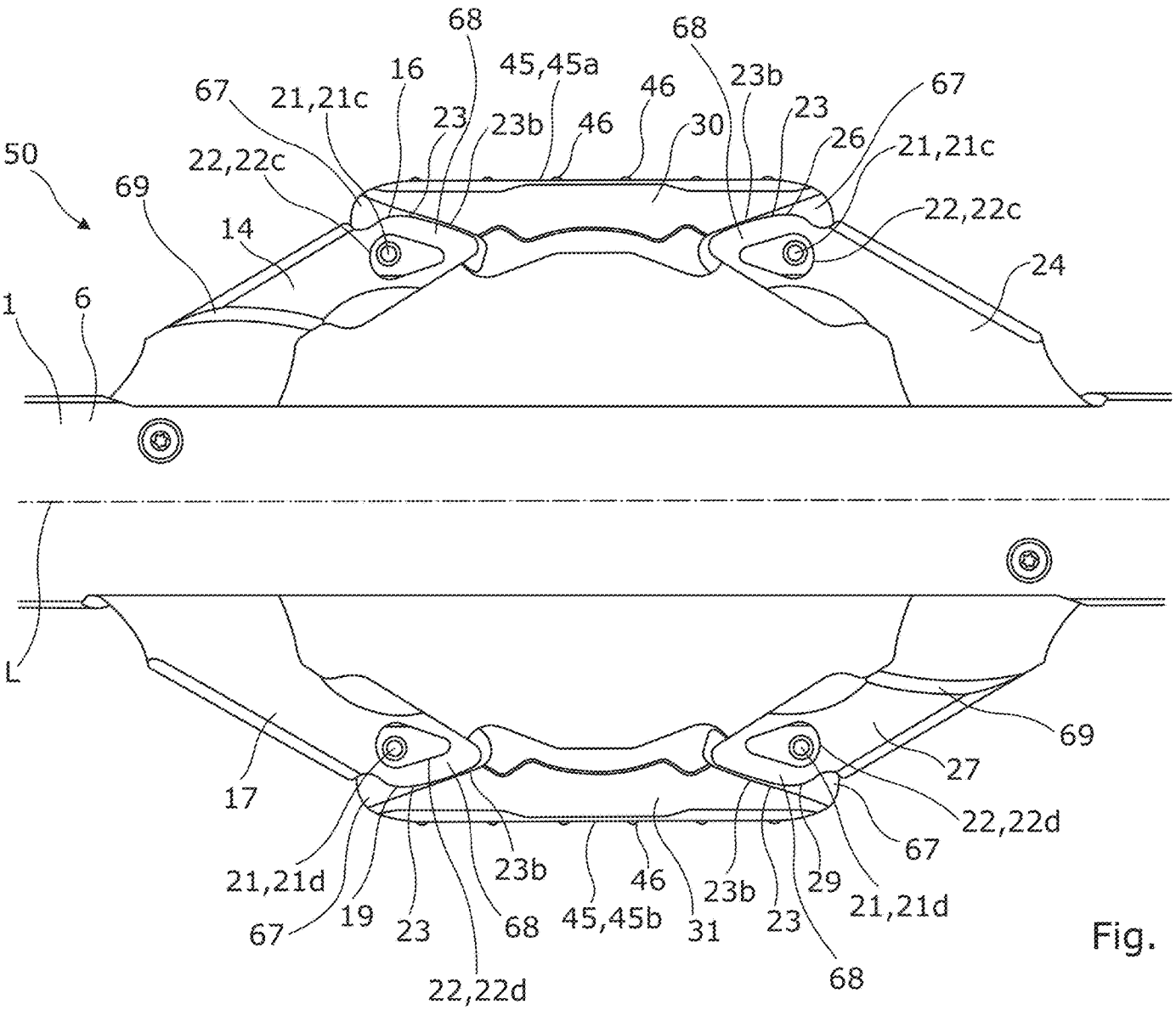
Figure 12:
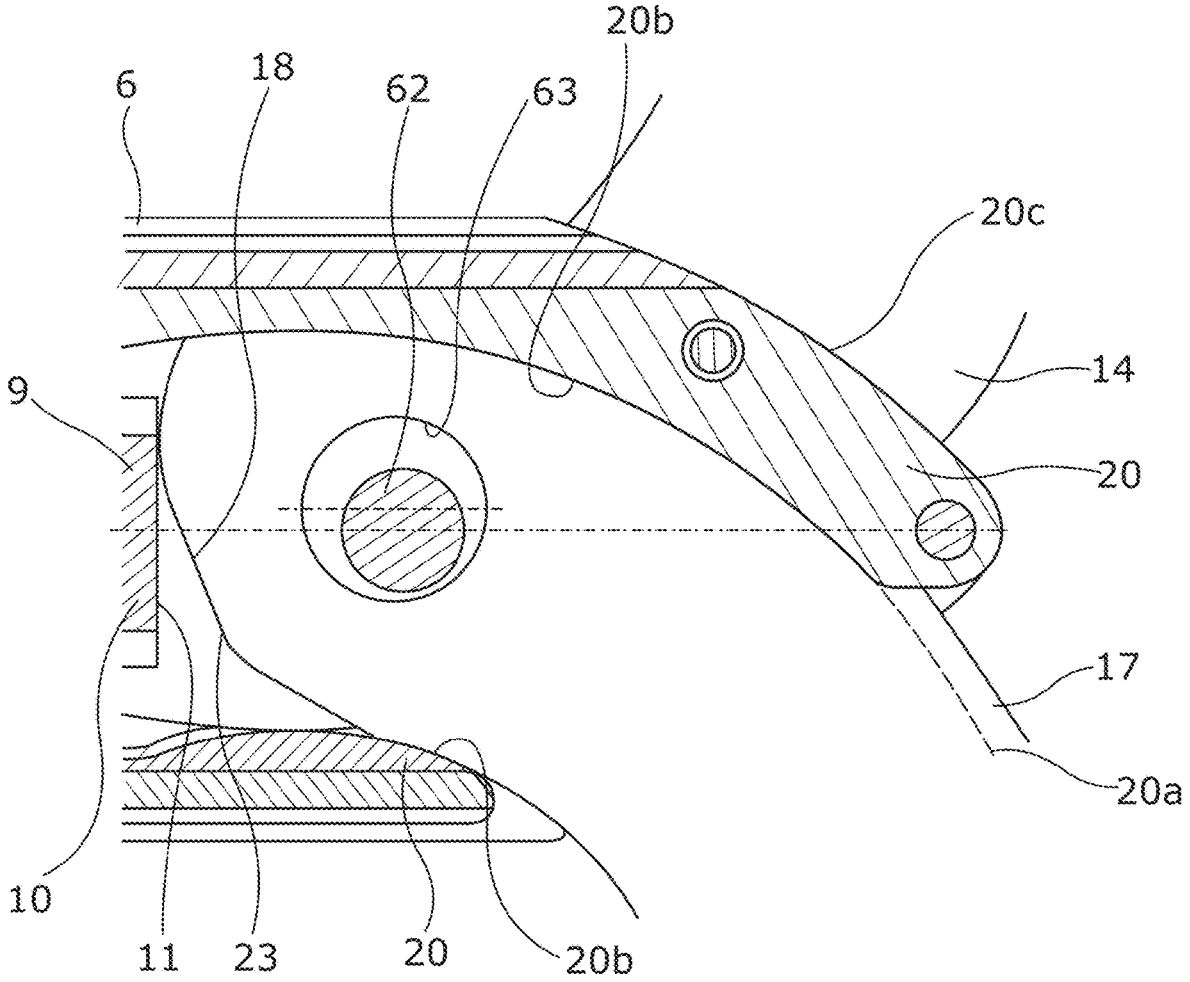

The invention and its many advantages will be described in more detail below with reference to the accompanying schematic drawings, which for the purpose of illustration show some non-limiting embodiments and in which:

FIG. 1 shows a radial force tool assembly in a projected condition in a well tubular metal structure in a borehole for anchoring an intervention tool in a well before performing an operation in the well, FIG. 2 shows another radial force tool assembly in a projected condition and used as a centraliser of an intervention tool, FIG. 3 shows yet another radial force tool assembly in a projected condition and used as a roller, FIG. 4 shows a partly cross-sectional view of another radial force tool assembly, FIG. 5 shows another partly cross-sectional view of the radial force tool assembly of FIG. 4, FIG. 6 shows yet another partly cross-sectional view of the radial force tool assembly of FIG. 4, FIG. 7 shows a partly cross-sectional view of another radial force tool assembly, FIG. 8 shows a partly cross-sectional view of part of another radial force tool assembly, FIG. 9 shows a side of part of yet another radial force tool assembly where the arm members are retracted in the cavity, FIG. 10 shows a side of a downhole intervention tool having a radial force tool assembly and a stroking tool, FIG. 11 shows a side of another radial force tool assembly in a projected condition in a well tubular metal structure in a borehole for anchoring an intervention tool in a well before performing an operation in the well, and FIG. 12 shows partly cross-sectional view of part of yet another radial force tool assembly where the arm members are projected from the tool body.

All the figures are highly schematic and not necessarily to scale, and they show only those parts which are necessary in order to elucidate the invention, other parts being omitted or merely suggested.

FIG. 1 shows a radial force tool assembly 1 providing a radial force F perpendicularly to an axial extension 2 of the radial force tool assembly 1 in a well 3 for anchoring the radial force tool assembly 1 and preventing at least axial movement along the axial extension 2. The radial force tool assembly 1 thus also centralises the radial force tool assembly 1 in a well tubular metal structure 3*a* in a borehole 3*b*. The radial force tool assembly 1 has a centre axis L, a front end 4 and a rear end 5, and comprises a tool body 6 comprising a cavity 7 having a longitudinal extension along the axial extension 2 of the tool assembly 1 and extending across the tool body 6. The cavity 7 comprises a first cavity face 7*a* facing opposite a second cavity face 7*b* so that the cavity 7 has two side faces being the first cavity face 7*a* and the second cavity face 7*b*. The radial force tool assembly 1 further comprises a first actuator 8, 8*a* moving a first force-transmitting member 9, 9*a* in relation to the tool body 6 along the axial extension 2. As shown in FIG. 4, the first force-transmitting member 9, 9*a* has a first end 10 with a first face 11 and a second face 12, the first and second faces 11, 12 are inclining in opposite directions, and thus the first and second faces 11, 12 are first and second inclined faces 11, 12. In FIGS. 7 and 12, the first force-transmitting member 9, 9*a* has the first face 11 and the second face 12, the first and second faces 11, 12 are extending radially to the axial extension 2. In FIG. 12, the first and second faces 11, 12 are one common face. The radial force tool assembly 1 further comprises a first rear arm member 14, and as shown in FIG. 4, the first rear arm member 14 has a first end face 15 abutting the first face 11 and a second end face 16, and the radial force tool assembly 1 further comprises a second rear arm member 17 having a first end face 18 abutting the second face 12 and a second end face 19. Each of the first end faces 18 has a curvature 23 following an involute of a circle so that when the first force-transmitting member 9, 9*a* moves from its initial position towards the front end 4, the first end face 15 of the first rear arm member 14 rolls on the first face 11, projecting the first rear arm member 14 radially outwards in a first radial direction D1, and the first end face 18 of the second rear arm member 17 rolls on the second face 12, projecting the second rear arm member 17 radially outwards in a second radial direction D2 opposite the first radial direction D1, while the first and second rear arm members 14, 17 move from a retracted position to a projected position as shown in FIGS. 1-7 and 10.

The curvature 23 shown in FIG. 4 is following an involute of a circle, which enables the first end face 15 of the first rear arm member 14 to roll and not slide on the first face 11 as the first rear arm member 14 is projecting radially outwards in the first radial direction D1. In the same way, the first end face 15 of the second rear arm member 17 is enabled to roll and not slide on the second face 12 while the first force-transmitting member 9, 9*a* moves from its initial position towards the front end 4. Each of the first end faces 15 has a curvature 23 following an involute of a circle so that each first end face 15 is shaped like the profile of half of a tooth of an involute gear. In another embodiment, the first end faces 15 have a curvature 23 so that each first end face 15 is shaped like the profile of half of a tooth of an involute gear, a trochoid gear or a cycloidal gear.

In prior art tools, the members are hingedly or "linkagely" connected, and such connection generates high friction causing wear in the connection. Furthermore, in the present radial force tool assembly 1, the force is translated and transmitted almost entirely from the first force-transmitting member 9, 9*a* to the first and second rear arm members 14, 17 in an optimal manner without losing a substantial amount of force.

The radial force tool assembly 1 further comprises a first front arm member 24 and a second front arm member 27 as shown in FIG. 1. As shown in FIG. 4, the first front arm member 24 has a first end face 25 and a second end face 26, and the second front arm member 27 has a first end face 28 and a second end face 29. As can be seen, the second end faces 16, 19, 26, 29 of all arm members have a curvature 23, 23*b*. The radial force tool assembly 1 further comprises a first contact element 30 and a second contact element 31 as shown in FIGS. 1 and 4. The first contact element 30 is connected with the second end faces 16, 26 of the first rear arm member 14 and the first front arm member 24, and the second contact element 31 is connected with the second end faces 19, 29 of the second rear arm member 17 and the second front arm member 27. By having four arm members 14, 17, 24, 27 connected with two contact elements 30, 31, the force is translated between a curvature 23, 23*a*, 23*b*, 23*c*, 23*d* following an involute of a circle and a face 11, 12, 64, 65, 33, 34 e.g. being inclined or with a matching curvature as between two gear parts like in a rack and pinion gear, and the translating and transferring of force occur in a rolling motion like that of an involute gear. A similar effect occurs when the rolling motion is like that of a trochoid gear or a cycloidal gear.

By having the curvature on all second end faces 16, 19, 26, 29 of the arm members following an involute of a circle, the translation of force is like in a gear where the same amount of force is translated in every position, so in other words the radial force tool assembly translates equally amount of force in every position i.e. the same translation of force in both fully extended and almost retracted.

In FIG. 4, the first rear arm member 14 or the first cavity face 7*a* comprises a projection 21, 21*a* engaging a guide 22, 22*a* in the other of the first rear arm member 14 and the first cavity face 7*a*, and the second rear arm member 17 or the second cavity face 7*b* comprises a projection 21, 21*b* engaging a guide 22, 22*b* in the other of the second rear arm member 17 and the second cavity face 7*b*. In the projection position as shown, the first rear arm member 14 projects radially outwards in the first radial direction D1, and the second rear arm member 17 projects radially outwards in the second direction D2 opposite the first radial direction D1, which radial projections are performed while the projections 21, 21*a*, 21*b* slide in the guides 22, 22*a*, 22*b*. By having projections and guides, the movement of the arm members 14, 17 is controlled as a pivot point/centre P of the arm members 14, 17 is arranged outside the tool body 6 as shown in FIG. 7. The force from the actuator 8 is transferred from the first and second faces 11, 12 to the curvature 23 of the first and second rear arm members 14, 17. This force is again transferred to the wall of the well tubular metal structure 3*a* or the borehole 3*b* via the second end faces 16, 19.

Thus, the connection of the arm members to the tool body is different from the main force translation area as this occurs at the curvature of the arm members.

As shown in FIG. 6, the first rear arm member 14 comprises a first wing profile 71 having a wing curvature 81, and the second rear arm member 17 comprises a first wing profile 72 (shown in FIG. 5) having a wing curvature 82 (shown in FIG. 5), where the wing curvature 81 of the first rear arm member 14 rolls on the wing curvature 82 of the second rear arm member 17 when the arm members 14, 17 project from the tool body 6. In this way, the first and second rear arm members 14, 17 provide support for each other so that a resulting force R, i.e. a pushing force, from the wall is transferred from the first rear arm member 14 to the second rear arm member 17 and vice versa via the wing profiles 71, 72, which are a part of the arm members 14, 17. The first and second rear arm members 14, 17 are retracted via an engagement between the first force-transmitting member 9, 9*a* and each of the first and second rear arm members 14, 17 so that when the first force-transmitting member 9, 9*a* is retracted by the actuator 8, the first force-transmitting member 9, 9*a* engages the first and second rear arm members 14, 17. The wing profiles 71, 72 thus provide a rolling radius face along which the arm members 14, 17 are rolling and supporting each other without losing any substantial force. In this way, the first and second rear arm members 14, 17 are projected from the tool body 6 and provide a radial force F to the wall of the well tubular metal structure 3*a* where the force from the actuator 8 is almost directly transferred to the wall, and the force is transferred in an equal manner to both the first and second rear arm members 14, 17. As shown in FIG. 7, the wing curvatures 81, 82 shown in FIG. 5 have the centre point P positioned outside the radial force tool assembly 1.

The radial force tool assembly 1 further comprises the first front arm member 24 and the second front arm member 27 as shown in FIG. 1. As shown in FIG. 4, the first front arm member 24 has the first end face 25 and the second end face 26, and the second front arm member 27 has the first end face 28 and the second end face 29. The first front arm member 24 or the first cavity face 7*a* comprises a projection 21, 21*c* engaging a guide 22, 22*c* in the other of the first front arm member and the first cavity face 7*a*, and the second front arm member 27 or the second cavity face 7, 7*b* comprises a projection 21, 21*d* engaging a guide 22, 22*d* in the other of the second front arm member 27 and the second cavity face 7*b*.

When projected as shown in FIG. 1, the first rear arm member 14 extends in a first diagonal direction DD1 between the first radial direction D1 and the axial extension 2, and at a first angle $\alpha$1 to the axial extension 2, and the second rear arm member 17 extends in a second diagonal direction DD2 between the second radial direction D2 and the axial extension 2, and at a second angle $\alpha$2 to the axial extension 2. The first front arm member 24 extends in a third diagonal direction DD3 between the first radial direction D1 and the axial extension 2, and at a third angle $\alpha$3 to the axial extension 2, and the second front arm member 27 extends in a fourth diagonal direction DD4 between the second radial direction D2 and the axial extension 2, and at a fourth angle $\alpha$4 to the axial extension 2. The first diagonal direction DD1 and the third diagonal direction DD3 are parallel, and the second diagonal direction DD2 and the fourth diagonal direction DD4 are parallel. The first angle $\alpha$1, the second angle $\alpha$2, the third angle $\alpha$3 and the fourth angle $\alpha$4 are of equal size. The first angle $\alpha$1, the second angle $\alpha$2, the third angle $\alpha$3 and the fourth angle $\alpha$4 may be in the range of 0-60°, preferably in the range of 0-45°.

In FIG. 9, the cavity 7 extends along the axial extension 2. The first rear arm member 14 is slidably arranged in the cavity 7 and has a first arm centre axis A1 extending along the axial extension 2 at a first distance d1 to the centre axis L of the radial force tool assembly 1. The second rear arm member 17 is slidably arranged in the cavity 7 and has a second arm centre axis A2 extending along the axial extension 2 at a second distance d2 to the centre axis L of the radial force tool assembly 1, the first distance being equal to the second distance. The first front arm member 24 is slidably arranged in the cavity 7 and has the first arm centre axis A1.

The second front arm member 27 is slidably arranged in the cavity 7 and has the second arm centre axis A2. The cavity 7 is formed by a cut-out 60 in the tool body 6 providing the second cavity face 7*b* and a lid plate 61 providing the first cavity face 7*a*. The first rear arm member 14 and the second rear arm member 17 slide in the cavity 7 in a side-by-side manner so that the first wing profile 71 and the second wing profile 72 slide in relation to each other.

In FIG. 2, the first contact element 30 is connected with the second end faces 16, 26 of the first rear arm member 14 and the first front arm member 24 by means of another projection 21, 21*c* engaging a guide 22, 22*c*, and the second contact element 31 is connected with the second end faces 19, 29 of the second rear arm member 17 and the second front arm member 27 by means of another projection 21, 21*d* engaging a guide 22, 22*d*.

In another embodiment as shown in FIG. 4, each of the first contact element 30 and the second contact element 31 comprises a first face 64 and a second face 65. The first face 64 of the first contact element 30 abuts the second end face 16 of the first rear arm member 14, and the second face 65 of the first contact element 30 abuts the second end face 26 of the first front arm member 24. Also, the first face 64 of the second contact element 31 abuts the second end face 19 of the second rear arm member 17, and the second face 65 of the second contact element 31 abuts the second end face 29 of the second front arm member 27. In FIG. 4, the first faces 64 and the second faces 65 are inclined in relation to the axial extension 2, but in another embodiment not shown, the first faces 64 and the second faces 65 may be curved. Each of the second end faces 16, 19, 26, 29 of the first and second rear arm members 14, 17 and the first and second front arm members 24, 27 has a curvature 23*b* following an involute of a circle so that the second end faces 16, 19, 26, 29 roll on the first and second faces, and the first end faces 15, 18 of the first and second rear arm members 14, 17 roll on the faces 11, 12 of the first force-transmitting member 9, 9*a*, projecting the rear arm members 14, 17 radially outwards while the projections slide in the guides.

By having four arm members 14, 17, 24, 27 connected with two contact elements 30, 31 where the force is translated between a face 11, 12, 64, 65, e.g. being inclined or curved, and a curvature 23, 23*b* following an involute of a circle, the translation and transmission of force occurs in a rolling motion like that of an involute gear. The first half of the involute tooth is arranged as the first end face 15 of the first rear arm member 14, the second half of the involute tooth is arranged as the second end face 16 of the first rear arm member 14, and the first face 11 of the first force-transmitting member 9, 9*a* and the first face 64 of the first contact element 30 function as the engaging tooth so that the first rear arm member 14 is pressed in between the first face 64 and the first face 11. The other arm members 17, 24, 27 are arranged in a similar manner, and in this way the radial force at which the contact elements 30, 31 press towards the wall of the tubing or borehole 3*b* is the same independently of the angle of the arm members 14, 17, 24, 27. This is very different from the known solutions which use hinged connections, and where some also have a supporting roller structure. A similar effect occurs when the rolling motion is like that of a trochoid gear or a cycloidal gear.

The radial force tool assembly 1 further comprises a second actuator 8, 8*b* moving a second force-transmitting member 9, 9*b* in relation to the tool body 6 along the axial extension 2 in an opposite direction of the second force-transmitting member 9, 9*b*. The first and second actuators 8, 8*a*, 8*b* are linked so as to be moved by the same fluid or the same motor, and if moved by two motors, the motors are synchronised to move synchronically. The second force-transmitting member 9, 9*b* has a first end 32 with a first face 33 and a second face 34, and the first and second faces 33, 34 are inclining in opposite directions. The first end face 25 of the first front arm member 24 abuts the first inclined face 33, and the first end face 28 of the second front arm member 27 abuts the second inclined face 34 of the second force-transmitting member 9, 9*b*. Thus, by having the first force-transmitting member 9, 9*a* and the second force-transmitting member 9, 9*b* moving towards each other, the arm members are forced to move from both sides. The faces 11, 12, 33, 34 of the force-transmitting members 9, 9*a*, 9*b* transfer the force via the first end faces 15, 18, 25, 28 to the second end faces 16, 26, 19, 26 of the arm members and further to the first and second faces 64, 65 of the contact elements 30, 31.

In FIG. 1, the first contact element 30 has a first contact face 45, 45*a* facing radially outwards towards a wall 44 of the tubing/well tubular metal structure 3*a* or the borehole 3*b*, and the second contact element 31 has a first contact face 45, 45*b* facing radially outwards towards the wall 44 of the borehole 3*b*. The first contact faces 45, 45*a* of the first contact element 30 and the second contact element 31 are equipped with projections 46 such as spikes or similar projections for increasing the friction between the first contact faces 45, 45*a* and the wall 44. The radial force tool assembly 1 is thus an anchoring tool assembly.

In FIG. 3, the radial force tool assembly 1 is used to roll a downhole intervention tool 50 in the well 3. Thus, the first contact faces 45, 45*a*, 45*b* of the first contact element 30 and the second contact element 31 are equipped with rollers 47 so that the downhole intervention tool is supported in a rolling manner while moving in the well.

To ensure that one of the first rear arm member 14 and the first front arm member 24 is not projected more than the other of the first rear arm member 14 and the first front arm member 24, the first contact element 30 is equipped with first engagement elements 48, 48*a*, 48*b*, as shown in FIG. 5, where each first engagement element 48, 48*a*, 48*b* engages a second engagement element 49, 49*a*, 49*b* of the first rear arm member 14 and the first front arm member 24, respectively. Likewise, the second contact element 31 is equipped with first engagement elements 52, 52*a*, 52*b*, where each engages a second engagement element 53, 53*a*, 53*b* of the second rear arm member 17 and the second front arm member 27, respectively, as shown in FIG. 3. In FIG. 11, the first rear arm member 14 has a guide 22, 22*c* and the first contact element 30 has a projection 21, 21*c* or vice versa where the guide and the projection engage each other connecting the first rear arm member 14 with the first contact element 30. The second rear arm member 17 has a guide 22, 22*d*, and the second contact element 31 has a projection 21, 21*d* or vice versa where the guide and the projection engage each other connecting the second rear arm member 14 with the second contact element 31. The first and second front arm members 24, 27 are connected to the first and second contact elements 30, 31, respectively, in the same manner as the first and second rear arm members 14, 17. The first contact element 30 has two flanges 67 having the projections 21*c* and the arm members end in two end flanges 68 having the guides and extending on each side of the flanges 67. The projections are formed by pins extending into the guides after the two end flanges 68 have been arranged on each side of the flange 67. The guides are designed in an "eye"-shaped form so that the arm members can be projected and retracted while the projections are arranged in the guides.

The first front arm member 24 comprises a first wing profile 73 having a wing curvature 83, the second front arm member 27 comprises a first wing profile 74 having a wing curvature 84, and the wing curvature 83 of the first front arm member 24 rolls on the wing curvature 84 of the second front arm member 27 when the arm members project from the tool body 6. In this way, the first and second front arm members 24, 27 provide support for each other so that a resulting force R, i.e. a pushing force, from the wall is transferred from the first front arm member 24 to the second front arm member 27 and vice versa via the wing profiles 73, 74, which are a part of the arm members 24, 27. The first and second rear arm members 14, 17 and the first and second front arm members 24, 27 are retracted via an engagement between the first and second force-transmitting members 9, 9*a*, 9*b* and each of the first and second front arm members 24, 27 so that when the first and second force-transmitting members 9, 9*a*, 9*b* are retracted by the actuator 8, 8*a*, 8*b*, the first and second force-transmitting members 9, 9*a*, 9*b* engage the arm members 14, 17, 24, 27. The wing profiles 71, 72, 73, 74 thus provide a rolling radius face along which the arm members 14, 17, 24, 27 are rolling and supporting each other without losing any substantial force. Thus, in the same way as the rear arm members 14, 17, the first and second front arm members 24, 27 are projected from the tool body 6 and provide a radial force F to the wall of the well tubular metal structure 3*a*, where the force from the second actuator 8, 8*b* is almost directly transferred to the wall, and the force is transferred in an equal manner to that of both the first and second front arm members 24, 27. As shown in FIG. 7, the wing curvatures 81, 82, 83, 84 (shown in FIG. 5) have a centre point P positioned outside the radial force tool assembly 1, and in the same way the wing curvatures 83, 84 of the first and second front arm members 24, 27 have a centre point P positioned outside the radial force tool assembly 1. Returning to FIG. 9, the first front arm member 24 and the second front arm member 27 slide in the cavity 7 in a side-by-side manner so that the first wing profile 73 and the second wing profile 74 (shown in FIG. 5) slide in relation to each other.

In FIG. 12, the wing profiles of the arm members 14, 17, 24, 27 are replaced with guides 20 fixedly arranged in the tool body 6 so that the arm members 14, 17, 24, 27 slide along the dotted line 20*a* when projecting or retracting. Thus, the arm members are free of wing profiles. This enables a simpler design of each arm member. The arm members are curved along line 20*a* with their first ends matching the inner curvature 20*b* of the guides 20 to stabilise the projecting and retracting of the arm members. The guides have an outer curvature 20*c* matching an arm curvature 69 (shown in FIG. 11) of the arm members so that the arm members can be fully retracted into the tool body 6.

In FIG. 7, the actuator 8 is an electric actuator 35 having an electric motor 36 providing a linear movement of a shaft 37 along the axial extension 2 via a gear unit 38, and in FIG. 6 the actuator 8 is a hydraulic actuator 39 that comprises a piston 40 moving in a chamber 41 in the tool body 6 along the axial extension 2. A spring element 43 in the chamber 41 is compressed as the piston 40 moves to project the arm members 14, 17, 24, 27. The first force-transmitting member 9, 9*a* and/or the second force-transmitting member 9, 9*b* is connected to the shaft 37, and fluid may at least partly flow from the pump to the chamber 41 and to the hydraulic actuator 39 via fluid channels. Part of the fluid channels may be arranged in the tool body 6 with an outlet opposite the chamber 41. The radial force tool assembly 1 has a first fluid channel for pumping fluid into the chamber 41 on a first side of the piston 40 for moving the piston and thus the force-transmitting members 9, 9*a*, 9*b* to project the arm members 14, 17, 24, 27, and the radial force tool assembly 1 has a second fluid channel for returning the fluid in the chamber to the other second side of the piston.

As shown in FIG. 9, the arm members 14, 17, 24, 27 have a retracted position in which the arm members are arranged in the cavity 7, and as shown in FIGS. 1-7 and 10, the arm members have a projected position in which the arm members project from the tool body 6.

The force-transmitting member 9 has a projection 62 sliding in a slot 63 extending along the axial extension 2 of the tool body 6 as shown in FIG. 8. The projection 21 is shown engaging a guide 22, and the guide 22 and the projection 21 have a curvature following an involute of a circle with the centre/pivot point P positioned outside the radial force tool assembly 1. In FIG. 12, the force-transmitting member 9 has a projection 62 sliding in a circular slot 63. The arm members 14, 17, 24, 27 slide along the guide 20 which replaces the projection 21 shown in FIG. 8 engaging a guide 22.

Thus, the connection of the arm members to the contact elements is different from the main force translation area as this occur at the curvature of the arm members.

As shown in FIG. 10, the tool body 6 has an outer diameter OD, and in the projected position of the arm members 14, 17, 24, 27, the first contact face 45 of the first contact element 30 has a distance D to the first contact face 45 of the second contact element 31, and this distance is at least 4 times the outer diameter OD. The radial force tool assembly 1 is thus able to project from the outer diameter OD to the distance D, which is at least 3 times, preferably at least 4 times, the outer diameter of the tool body 6. The first contact faces 45 may have a round outer shape if seen along the axial extension so as to better fit the inner wall of the well tubular metal structure to which they abut.

FIG. 10 shows a downhole intervention tool 50 comprising the radial force tool assembly 1 and a stroking tool 94, and the downhole intervention tool 50 further comprises an electric motor 92 powered by a wireline 91 and driving a pump 93 supplying hydraulic fluid to the stroking tool 94 for providing an axial force on an element 95 by means of a hydraulic cylinder 96.

A stroking tool is a tool providing an axial force. The stroking tool comprises an electric motor for driving a pump. The pump pumps fluid into a piston housing to move a piston acting therein. The piston is arranged on the stroker shaft. The pump may pump fluid out of the piston housing on one side and simultaneously suck fluid in on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion or open hole, and by oil is meant any kind of oil composition, such as crude oil, an oil-containing fluid, etc. Gas, oil and water fluids may thus all comprise other elements or substances than gas, oil and/or water, respectively.

By tubing, casing or well tubular metal structure is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A radial force tool assembly for providing a radial force perpendicularly to an axial extension of the radial force tool assembly in a well for anchoring, centralising or rolling a downhole intervention tool in a well having a borehole, the radial force tool assembly having a centre axis, a front end and a rear end, and comprising:

a tool body comprising a cavity extending across the tool body, the cavity comprising a first cavity face facing opposite a second cavity face, a first actuator moving a first force-transmitting member in relation to the tool body along the axial extension, wherein the first force-transmitting member has a first end with a first face and a second face, and a first rear arm member having a first end face abutting the first face and a second end face, and a second rear arm member having a first end face abutting the second face and a second end face, wherein an axial force of the first force-transmitting member is transmitted to the first rear arm and the second rear arm via the first face and the second face, and wherein each of the first end faces has a curvature so that when the first force-transmitting member moves towards the front end, the first end face of the first rear arm member rolls on the first face, projecting the first rear arm member radially outwards in a first radial direction, and the first end face of the second rear arm member rolls on the second face, projecting the second rear arm member radially outwards in a second radial direction opposite the first direction while projecting the first and second rear arm members.

2. A radial force tool assembly according to claim 1, wherein each of the second end faces of the first and second rear arm members has a curvature, the curvature being shaped like the profile of half of a tooth of an involute gear, a trochoid gear or a cycloidal gear.

3. A radial force tool assembly according to claim 1, wherein the first rear arm member or the first cavity face comprises a projection engaging a guide in the other of the first rear arm member and the first cavity face, and the second rear arm member or the second cavity face comprises a projection engaging a guide in the other of the second rear arm member and the second cavity face, wherein the projection of the first rear arm member radially outwards in a first direction and the projection of the second rear arm member radially outwards in a second radial direction opposite the first direction are performed while the projections slide in the guides.

4. A radial force tool assembly according to claim 3, further comprising a second actuator moving a second force-transmitting member in relation to the tool body along the axial extension, the second force-transmitting member having a first end with the first face and a second face, the first and second faces inclining in opposite directions, wherein the first end face of the first front arm member abuts the first face, and the first end face of the second front arm member abuts the second face of the second force-transmitting member.

5. A radial force tool assembly according to claim 1, further comprising a first front arm member having a first end face and a second end face, and a second front arm member having a first end face and a second end face, the first end faces abut a first face in the tool body.

6. A radial force tool assembly according to claim 5, wherein the first and second end faces of the first front arm member and the first second arm member have a curvature, the curvature being shaped like the profile of half of a tooth of an involute gear, a trochoid gear or a cycloidal gear.

7. A radial force tool assembly according to claim 5, wherein the radial force tool assembly further comprises a first contact element and a second contact element, the first contact element being connected with the second end faces of the first rear arm member and the first front arm member, and the second contact element being connected with the second end faces of the second rear arm member and the second front arm member.

8. A radial force tool assembly according to claim 7, wherein the first contact element is connected with the second end faces of the first rear arm member and the first front arm member by means of another projection engaging a guide, and the second contact element is connected with the second end faces of the second rear arm member and the second front arm member by means of another projection engaging a guide.

9. A radial force tool assembly according to claim 8, wherein the first contact element has a first contact face facing radially outwards towards a wall of a tubing or the borehole, and the second contact element has a first contact face facing radially outwards towards the wall of the borehole.

10. A radial force tool assembly according to claim 8, wherein each of the first contact element and the second contact element comprises a first face and a second face, the first face of the first contact element abutting the second end face of the first rear arm member, the second face of the first contact element abutting the second end face of the first front arm member, the first face of the second contact element abutting the second end face of the second rear arm member, and the second face of the second contact element abutting the second end face of the second front arm member.

11. A radial force tool assembly according to claim 5, wherein each of the second end faces of the first and second rear arm members and the first and second front arm members has a curvature so that the second end face rolls on the first and second faces, and the first end faces of the first and second rear arm members roll on the first and second faces of the first force-transmitting member, projecting the arm members radially outwards while the projections slide in the guides.

12. A radial force tool assembly according to claim 1, wherein the force-transmitting member has a projection or a circular slot engaging the other of the projection and the circular slot of the first rear arm member and the second rear arm member.

13. A radial force tool assembly according to claim 1, wherein the first face and the second face of the first end of the force-transmitting member(s) may be one common face.

14. A radial force tool assembly according to claim 1, wherein the tool body has an outer diameter, and in the projected position of the arm members, the first contact face of the first contact element has a distance to the first contact face of the second contact element, which distance is at least 4 times the outer diameter.

15. A downhole intervention tool comprising the radial force tool assembly according to claim 1 and a stroking tool, and the downhole intervention tool further comprises an electric motor powered by a wireline and driving a pump supplying hydraulic fluid to the stroking tool for providing an axial force on an element by means of a hydraulic cylinder.

16. A radial force tool assembly according to claim 1, wherein each of the first end faces extends in a plane that is not parallel to the centre axis, the first end face of the first rear arm member rolls on the first face to contact one another in a plane that is parallel to the first end face of the first rear arm member and the first face, and the first end face of the second rear arm member rolls on the second face to contact one another in a plane that is parallel to the first end face of the second rear arm member and the second face.

17. A radial force tool assembly according to claim 16, wherein the first end face of the first rear arm includes a first portion along the curvature and a second portion along the curvature, and wherein, when as the first end face of the first rear arm member rolls on the first face, the first portion of the first end face contacts the first face at a first angle of the first rear arm, and the second portion of the first end face contacts the first face at a second angle of the first rear arm, the first and second angles being different from one another.

* * * * *